US011224301B2

(12) United States Patent
Delgado Carmona

(10) Patent No.: US 11,224,301 B2
(45) Date of Patent: Jan. 18, 2022

(54) BEVERAGE CONTAINER OPEN INDICATOR

(71) Applicant: Dart Industries Inc., Orlando, FL (US)

(72) Inventor: Sara L. Delgado Carmona, Orlando, FL (US)

(73) Assignee: Dart Industries Inc., Orlando, FL (US)

( * ) Notice: Subject to any disclaimer, the term of this patent is extended or adjusted under 35 U.S.C. 154(b) by 228 days.

(21) Appl. No.: 16/693,810

(22) Filed: Nov. 25, 2019

(65) Prior Publication Data

US 2021/0153672 A1 May 27, 2021

(51) Int. Cl.

| | |
|---|---|
| ***A47G 19/22*** | (2006.01) |
| ***B65D 43/02*** | (2006.01) |
| ***B65D 51/24*** | (2006.01) |
| ***B65D 53/02*** | (2006.01) |
| ***B65D 47/24*** | (2006.01) |

(52) U.S. Cl.

CPC ..... *A47G 19/2227* (2013.01); *A47G 19/2272* (2013.01); *B65D 43/0231* (2013.01); *B65D 47/246* (2013.01); *B65D 51/242* (2013.01); *B65D 51/248* (2013.01); *B65D 53/02* (2013.01); *B65D 2543/00046* (2013.01); *B65D 2543/00092* (2013.01); *B65D 2543/00231* (2013.01); *B65D 2543/00527* (2013.01); *B65D 2543/00537* (2013.01)

(58) Field of Classification Search

CPC B65D 47/246; B65D 47/242; B65D 34/0231; B65D 2543/00046; B65D 2543/0023; B65D 2251/0012; B65D 39/08; A47G 19/2272

USPC ..... 220/254.8

See application file for complete search history.

(56) References Cited

U.S. PATENT DOCUMENTS

| | | | | |
|---|---|---|---|---|
| 3,393,816 | A | 7/1968 | Grimm | |
| 5,147,066 | A | 9/1992 | Snider | |
| 5,660,302 | A | 8/1997 | Trout | |
| 6,102,244 | A * | 8/2000 | Kuwano | A47G 19/2272 220/711 |
| 2004/0094552 | A1* | 5/2004 | Featherston | A47G 19/2272 220/259.3 |
| 2010/0155358 | A1* | 6/2010 | George | B65D 47/244 215/356 |
| 2011/0114595 | A1 | 5/2011 | Heiberger | |
| 2017/0027350 | A1 | 2/2017 | Onza et al. | |
| 2020/0130904 | A1* | 4/2020 | Jones | A47G 19/2272 |

FOREIGN PATENT DOCUMENTS

| | | |
|---|---|---|
| CN | 202919352 U | 5/2013 |

* cited by examiner

*Primary Examiner* — Don M Anderson
*Assistant Examiner* — Jennifer Castriotta
(74) *Attorney, Agent, or Firm* — Taylor J. Ross

(57) ABSTRACT

A beverage container with a tactile indication of a properly open position for drinking. The beverage container includes a base, a collar, and a cap having an annular seal gasket for opening and closing the container for pouring/drinking. The improvement is a collar stop located on the collar, together with a pair of seal stops extending from the seal gasket and forming a notch therebetween. Rotation of the cap to open the container becomes more difficult as the collar stop interferes with the leading one of the seal stops. Continued rotation to seat the collar stop in the notch provides a tactile indication that the cap has rotated to the properly open position and further rotation may be avoided.

8 Claims, 5 Drawing Sheets

BEVERAGE CONTAINER OPEN INDICATOR

CROSS REFERENCE TO RELATED APPLICATIONS

Not applicable.

STATEMENT REGARDING FEDERALLY SPONSORED RESEARCH

Not applicable.

BACKGROUND OF THE INVENTION

The present invention relates in general to beverage containers from which a user drinks. In particular it relates to those beverage containers which have a storage body with a rim, an annular collar secured to that rim, and a circular cap threaded to the central opening of the collar. The collar includes one or more flow apertures, and rotation of the cap in one direction will cause the cap to lower and thus block these flow apertures to seal the container. Rotation of the cap in the opposite direction will cause the cap to rise and thus open the flow apertures to allow drinking.

It is common for a user to be unsure about the amount of rotation of the cap necessary for opening the container for drinking. Too little rotation will restrict flow and make it difficult to drink. Too much rotation, and there is a worry of the cap unexpectedly detaching from the collar and causing a serious spill. It has been known to provide markings on the cap and collar which come into alignment at the suggested optimum rotation, to provide a visual indication for the user. While an improvement, this requires visual inspection. This may be difficult in low light situations. Further, it is a dangerous distraction while driving.

SUMMARY OF THE INVENTION

An object of the present invention is to provide a beverage container with an indicator for the open position.

Another object of the present invention is to provide a beverage container with a tactile indication upon reaching a properly open position of the inner cover for drinking.

A further object of the present invention is to provide such a tactile indicator which also serves to maintain the cap in the properly open position against unintended rotation.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
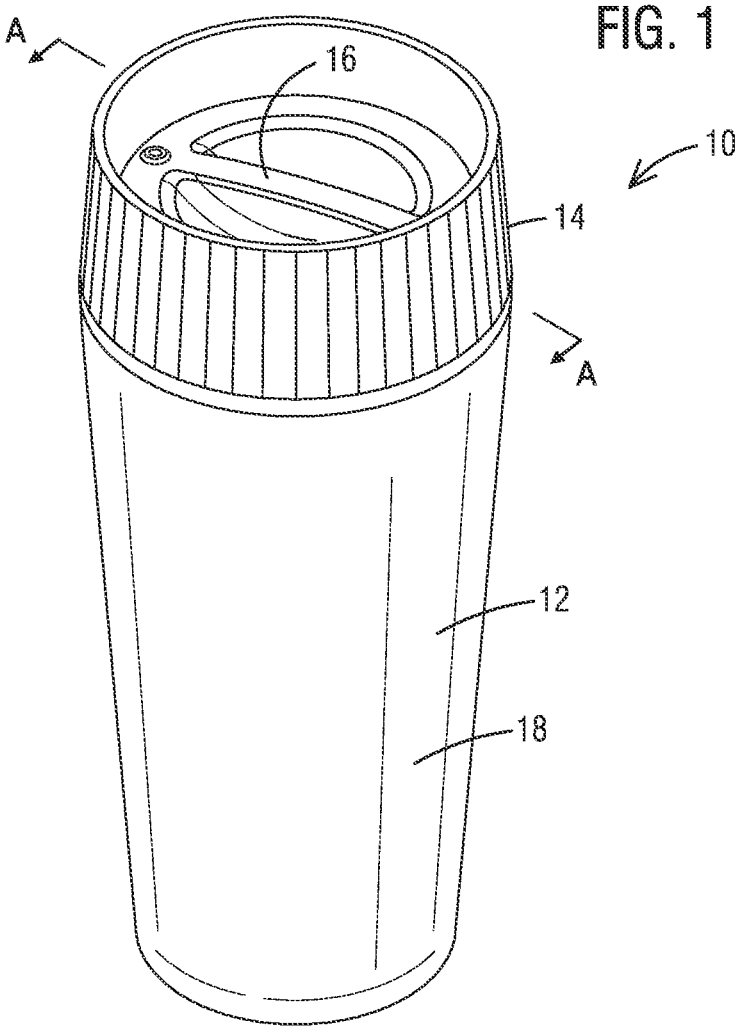
FIG. 1 is a top perspective view of the beverage container open indicator according to the present invention in the operative configuration.

With reference to FIG. 1, a beverage container open indicator according to the present invention is generally designated by reference numeral 10. The container 10 generally includes a base 12, collar 14, and cap 16. The base 12 is intended to hold a beverage, and consists generally of a concave body having at least one sidewall 18 terminating in an upper rim 20. In the embodiment shown the base 12 takes the form of a tumbler, but it could take other shapes and sizes, such a multi-cup insulated carafe for coffee or tea.

Figure 3:
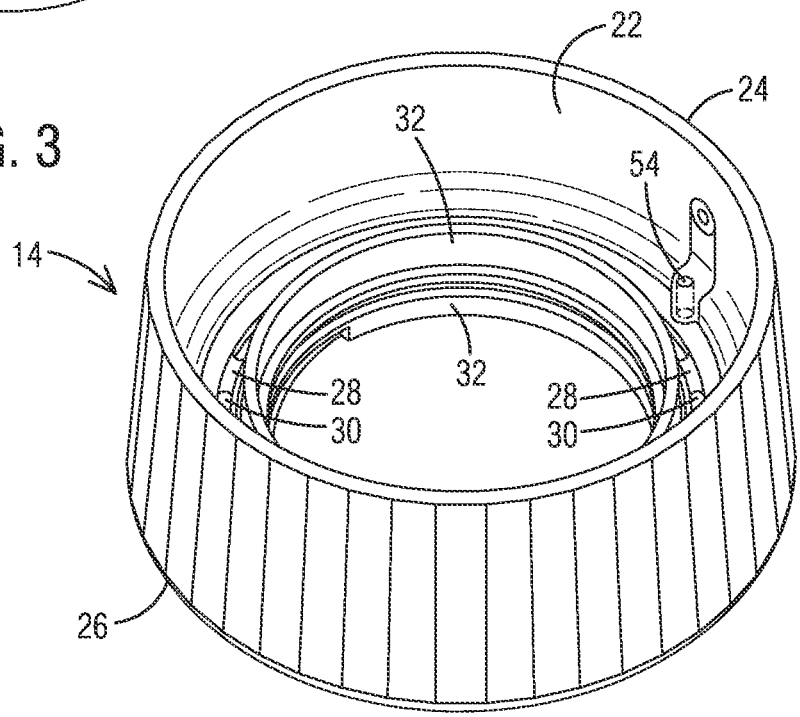
FIG. 3 is a top isometric view of a collar for the beverage container.
Figure 2:
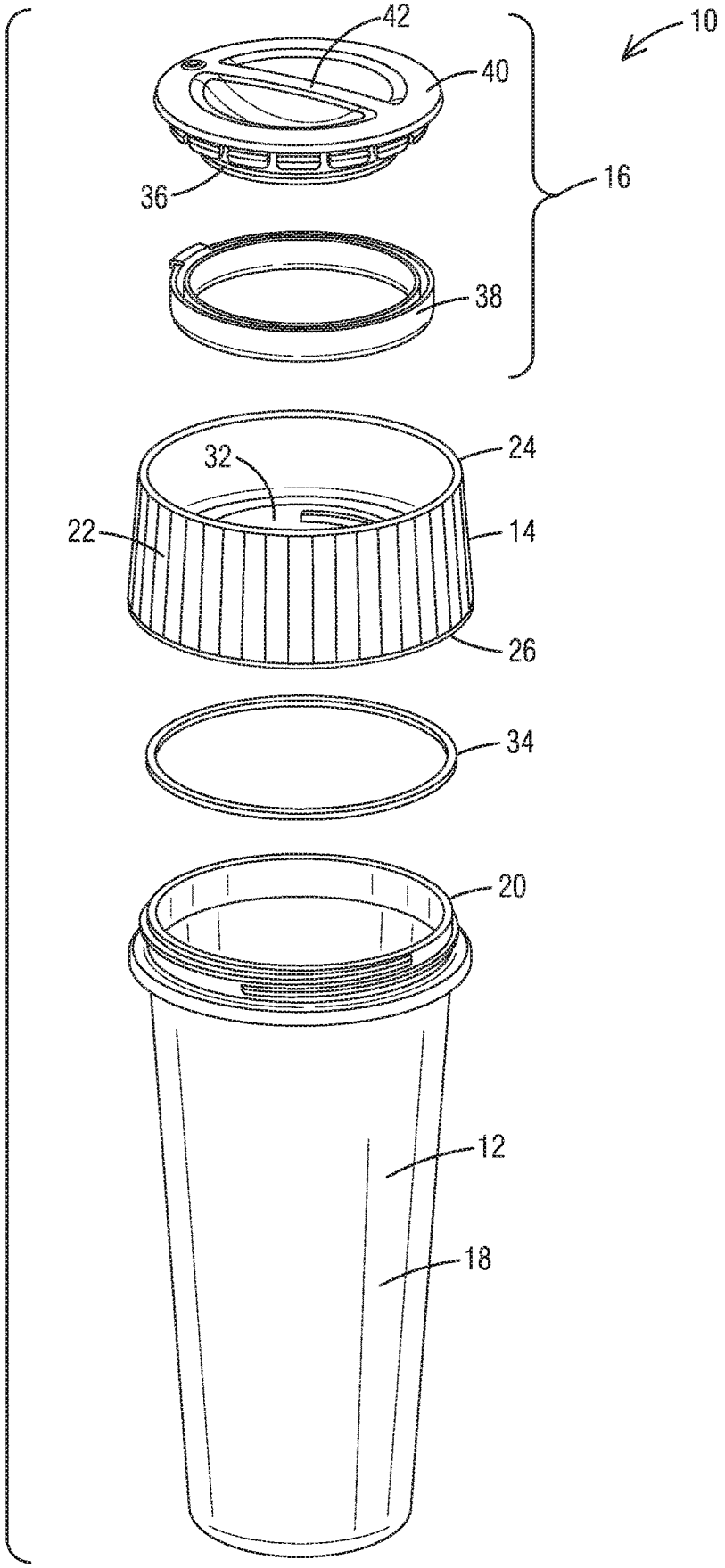
FIG. 2 is an exploded view of the beverage container of FIG. 1.
Figure 8:
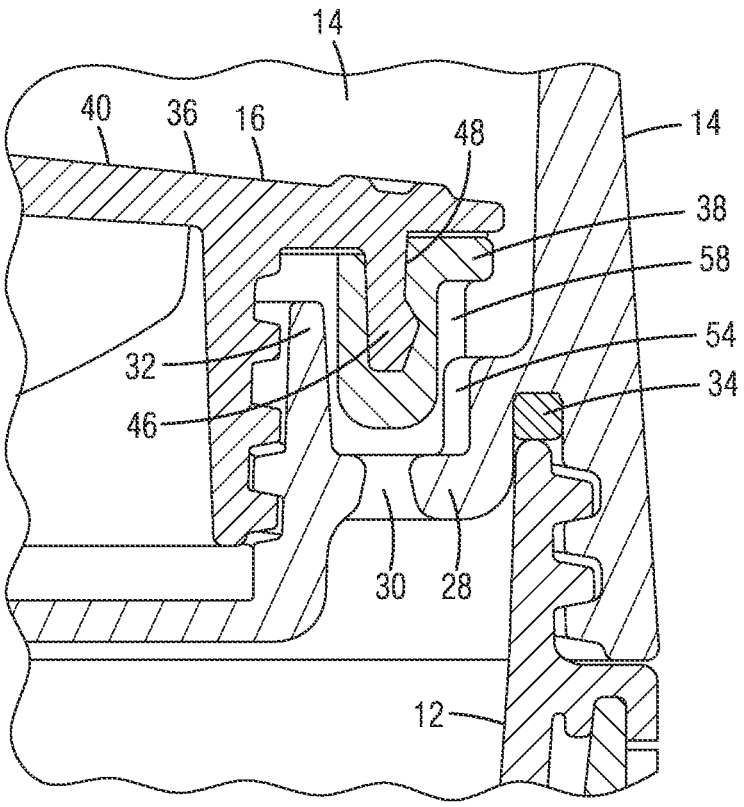
FIG. 8 is a detailed longitudinal cross-sectional view of an embodiment of the beverage container in an open position.
Figure 9:
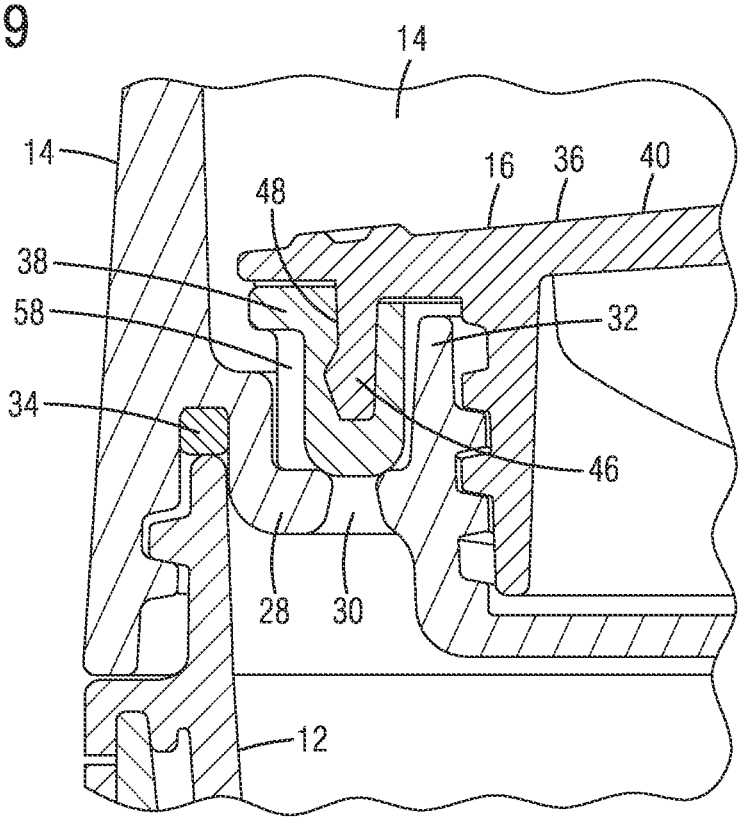
FIG. 9 is a detailed longitudinal cross-sectional view along line A-A of FIG. 1.

The collar 14 includes an outer wall 22 having a top end 24 and bottom end 26. Spaced from each of these ends 24 and 26 the collar 14 includes an inwardly extending flow ledge 28 which includes at least one flow aperture 30 extending therethrough (FIG. 3). The inner edge of the flow ledge 28 in turn mounts an annular collar shaft 32. The collar 14 mounts removably to the base 12. This mating may take various forms such as press fit or bayonet, but as best shown in FIGS. 2, 8 and 9 the preferred arrangement shown is for the upper rim 20 to be circular and include a set of threads. The collar 14 below the flow ledge will include a mating set of threads such that the collar 14 will screw on to the base 12. This screw connection may, by itself, be sufficient to prevent leaking during drinking/pouring. To ensure protection against leaking, it is preferred to include an elastomeric ring gasket 34 which takes a generally annular form (although the outer periphery could be faceted, an irregular polygon or other configurations if press fit is employed).

As may be envisioned, with the collar 14 mounted to the base 12, tilting of the combined components will cause liquid stored in the base to flow through one or more of the flow apertures 30, and thereafter flow over the top end 24 of collar 14. This will allow the user to drink the liquid which is stored in the base 12. For containers of this type, however, the true utility comes from selectively preventing this flow. This is the purpose of the cap 16.

Figure 4:
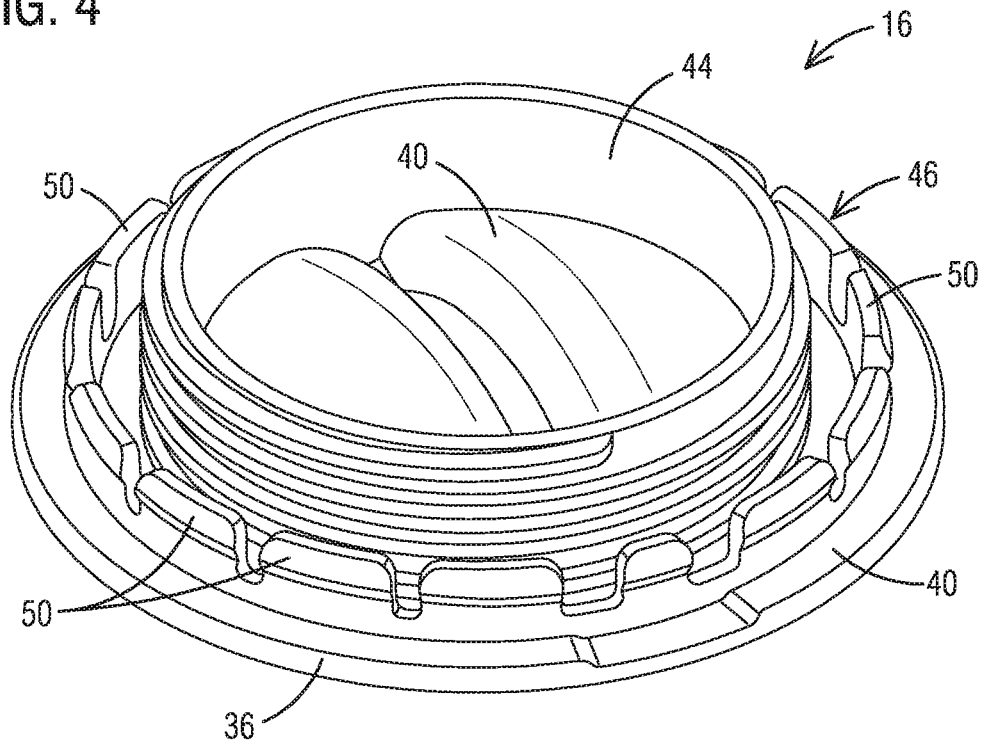
FIG. 4 is a bottom isometric view of a cap body for the beverage container.
Figure 5:
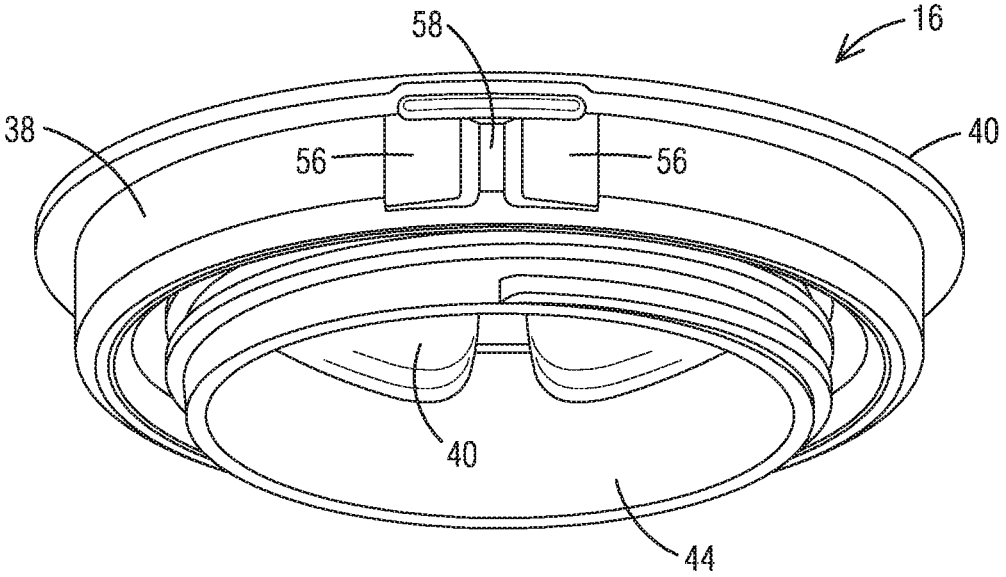
FIG. 5 is an isometric view of a cap for the beverage container.

As best shown by comparing FIGS. 2, 4 and 5, the cap 16 includes a cap body 36 and a seal gasket 38 mounted to the cap body 36. The cap body 36 includes a top plate 40 and a handle 42 (FIG. 2) to allow manual grasping and turning of the cap body 36. In the embodiment shown, this handle 42 is formed by a pair of spaced depressions with the portion between these depressions being readily grasped by a user. Other arrangements are possible such as a raised ridge extending upward (not shown), a pair of spaced protrusions (not shown), etc. The cap body 36 also includes a cap plug 44 extending longitudinally downward from the top plate 40.

The cap plug 44 is intended to interact with the collar shaft 32. In particular, the cap plug 44 and collar shaft 32 will each include an appropriate thread for mating with the other. In the embodiment shown, the cap plug 44 is closely received within the collar shaft 32, and as such the cap plug 44 include the threads on its exterior, and the collar shaft 32 includes the threads on its interior. This arrangement could be reversed, with the collar shaft received within the cap plug. As may be envisioned with reference to FIGS. 8 and 9, with these threads engaged the relative rotation of the cap 16 with respect to the collar 14 will cause the top plate 40 to move downward toward the bottom end 26 in a first rotational direction, and cause the top plate 40 to move upward toward the top end 24 in the opposite rotational direction.

The flow ledge 28 and flow apertures 30 are located radially exterior to the collar shaft 32. The top plate 40 is sized to also extend radially outward so as to overly the flow apertures 30. The cap body 36 further includes a seal ridge 46 extending downward from the top plate 40 at a position adjacent the flow apertures 30. The seal gasket 38 includes on its top face a mating seal groove 48 sized to receive the seal ridge 46 and thus removably mount the seal gasket 38 to the cap body 36. As illustrated best in FIGS. 8 and 9, once mounted the seal gasket 38 will be opposed to the flow apertures 30. With rotation of the cap 16 in the proper direction, the cap 16 will move downward toward bottom end 26 until the seal gasket 38 abuts and blocks the flow apertures 30. In this position, the beverage container 10 is water tight, and no liquid will exit the container 10 regardless of its orientation. Rotation of the cap 16 in the opposite direction will cause the seal gasket 38 to move away from and thus open the flow apertures 30, allowing the user to drink from the beverage container 10.

The arrangement described to this point is well known in the prior art. The inventive features will be described from this point forward. For reasons which will become clear, it is preferred to limit rotational slipping of the seal gasket 38 with respect to the cap body 36. To that end, the seal ridge 46 may be formed with an irregular free edge and the seal groove 48 have a variable depth for mating with this irregular free edge. Various arrangements are possible, but in the preferred form shown in FIGS. 4 and 6, the seal ridge will be formed with a series of radially spaced teeth 50, and the seal groove 48 will be formed with gap walls 52 sized and positioned to be received within the gaps between the teeth 50.

The collar 14 includes a collar stop 54 in the form of a small protrusion extending into the annular space between the collar outer wall 22 and the collar shaft 32 adjacent to the flow ledge 28. In fact, in the preferred embodiment shown, the collar stop 54 extends downward to merge with the flow ledge 28. The majority of the seal gasket 38 has a constant outer diameter and is sized such that is spaced radially inward from this collar stop 54 and may thus turn freely with respect to the collar 14. But at least one section of the seal gasket 38 includes a pair of seal stops 56. While not required, it is preferred that seal stops 56 are monolithic extensions of the seal gasket 38 formed during molding of the seal gasket 38. The seal stops 56 preferably extend radially outward a distance that they each overlap a portion of the collar stop 54 (best shown in FIGS. 7 and 3). In other words, each of the seal stops 56 will cause interference against the collar stop 54. Further, the pair of seal stops 56 are spaced from each other a distance to form a notch 58 sized to allow the collar stop 54 to be closely received therein. It is this movement of the collar stop 54 into and out of notch 58 which provides the tactile indication of cap position for the user.

While it is possible to provide tactile indication of the fully closed position of the cap 16 (preventing flow), it is felt that the resistance to further rotation upon seating of the seal gasket 38 against the flow ledge 28 will provide adequate tactile indication of the fully closed position. But the properly open position of the cap 16 is more difficult to determine. It is clear that the cap 16 may be rotated sufficiently that it is completely removable from the base 12 (to allow filling for example) and as such the container 10 would be fully open. The fact that the cap 16 may be rotated enough to be removed can cause lingering anxiety in the user as to how far the cap 16 has been rotated—and whether it was rotated too much and may fall free of the collar 14 as the container 10 is tipped for drinking. As may be envisioned, this would typically cause a larger-than-anticipated volume of liquid (potentially very hot liquid) to unexpectedly exit the container 10 in a spill over the user's face. The term "properly open position" is some rotational position of the cap 16 with respect to the collar 14 allowing free flow of liquid through the flow apertures 30 for drinking, while still securely retaining the cap 16 to the collar 14 to prevent such spills.

As such, it is preferred that the tactile indication provided by the collar stop 54 seating between the seal stops 56 be used to determine the properly open position of cap 16. Beginning with the cap 16 in its lowest position with seal gasket 38 closing the flow apertures 30, the notch 58 is rotationally (that is, circumferentially) offset relative to the collar stop 54. As the cap is rotated toward the open position, with the seal gasket uncovering the flow apertures 30, the notch 58 will come closer to the collar stop 54. During this period of rotation the seal gasket 38 does not interfere with the collar stop 54, and as such the cap turn easily upon manual rotation by the user. As the leading one of the seal stops 56 abuts against the collar stop 54, however, rotation of the cap 16 with respect to the collar 14 will become more difficult. The elastic nature of the seal gasket 38, together with appropriate dimensional overlap of the collar stop 54 and seal stops 56, will allow the leading one of the seal stops 56 to deform sufficiently to continue rotation of the cap with some effort. Once the leading one of the seal stops 56 is rotated past (and thus ceases to interfere with) the collar stop 54 there will be a brief moment of noticeably easier rotation immediately followed by rotation once again becoming more difficult as the trailing one of the seal stops 56 comes into interference with the collar stop 54. At this point, the collar stop 54 is received within the notch 58. As may be envisioned, this change in resistance to rotation of the cap 16, with the hard-easy-hard rotation occurring at a specified point of rotation, is noticeable by the user in a tactile sense. Further, the seating of collar stop 54 within notch 58 will assist in preventing further, unintended, rotation of cap 16.

The amount of rotation of the cap 16 from the closed position to the properly open position may vary. It is preferred, however, that the rotation be easily accomplished by the user. As such, it is preferred that the properly open position be between 15 and 90 degrees from the closed position. This amount of rotation is easily achieved without strain on the wrist. Other rotations to achieve the properly open position are of course possible.

Figure 6:
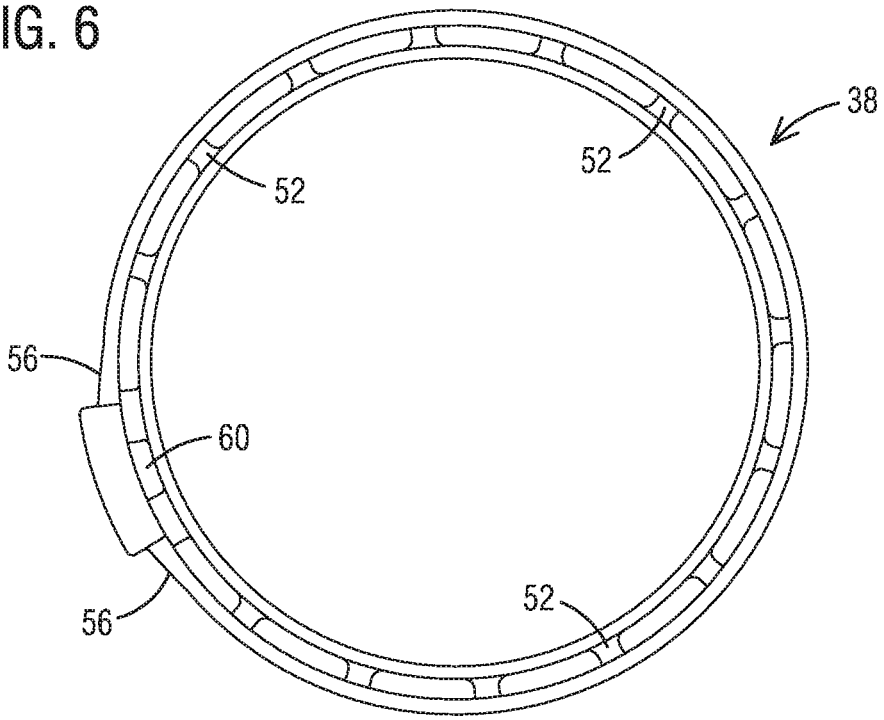
FIG. 6 is a top view of a seal gasket for the beverage container.
Figure 7:
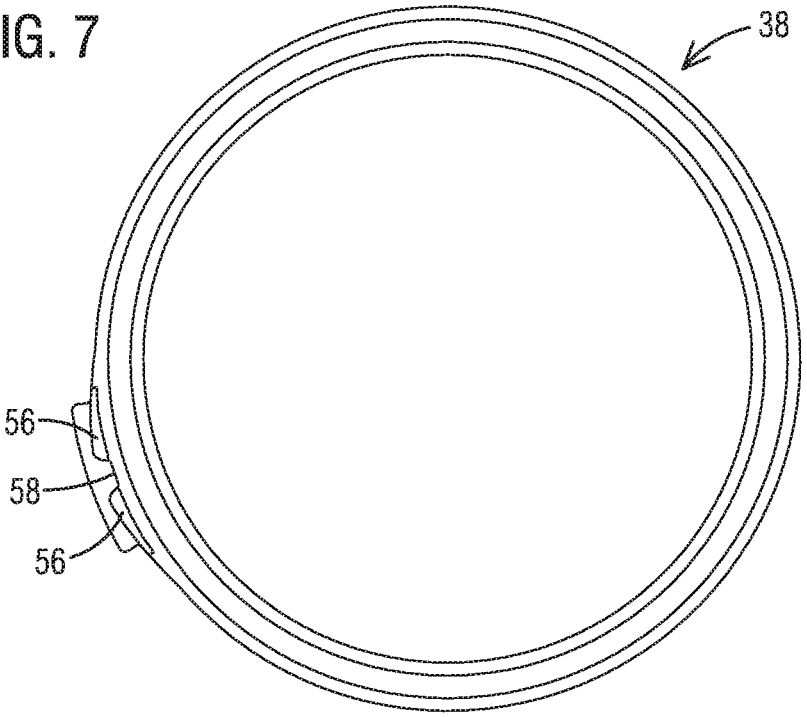
FIG. 7 is a bottom view of a seal gasket for the beverage container.

While the seal stops 56 may take many geometric forms, comparison of FIGS. 5-7 shows that in the preferred form each of the seal stops 56 takes the form of an inclined ramp increasing in depth toward the notch 58. This will cause a smoother camming effect to make the "click" of seating the notch 58 on the collar stop 54 even more apparent to the tactile sense. The movement of the seal stops 56 over the collar stop 54 may be possible purely via elastic deformation of the seal stops 56. However, as shown in FIG. 4, it may be preferred to remove or make smaller (not shown) the particular tooth 50 which would underlie the seal stops 56. This will permit greater flexibility of the seal gasket 38 in this location and thus the flexibility of seal stops 56. Additionally, it is preferred to keep the same clocking position of the seal gasket 38 on the cap body 36 with every use, as this will allow more predictability for reaching the properly open position and thus reducing user anxiety. The elimination or reduction of the particular tooth 50 underlying the seal stops 56 allows the particular gap wall 52 underlying the seal stops 56 to be of a different size as shown at 60 in FIG. 6. In this manner the seal gasket 38 may only be mounted on the cap body 16 with the desired clocking position, and cannot be improperly mounted.

While not required, it is also preferred that the mating threads on the collar shaft 32 and cap plug 44 have an incline such that the notch 58 will interact with collar stop only once during mounting or dismounting of the cap 16 to collar 14. As shown in FIG. 9, when the cap 16 is closed and the seal gasket engaged with the flow ledge 28 to seal the flow apertures 30, the notch 58 will be circumferentially offset from the collar stop 54 such that this cross-sectional view through notch 58 shows the notch 58 to be empty. As the cap 16 is rotated to open, the cap moves away from the flow ledge 28 until the properly open position is reached, as shown in FIG. 8. In this figure, which again shows a cross-section through notch 58, the collar stop 54 is received within the notch 58. Where the preferred form is used and the properly open position is reached within 15-90 degrees of rotation from closed, it is seen that the notch 58 has been raised with respect to the collar stop 54, but the collar stop 54 will still seat within the notch 58. Given this amount of vertical motion of the cap 16 during the small rotation to the properly open position, it may be easily envisioned that another 360 degree rotation of cap 16 with respect to collar 14 will (due to the thread angle) raise the seal stops 56 and notch 58 above the top edge of collar stop 54. As such, in this preferred arrangement the notch 58 will seat the collar stop 54 only once during a full opening or closing rotation. In this manner confusion is avoided as to the cap 16 reaching the properly open position.

From the foregoing it will be seen that this invention is one well adapted to attain all ends and objects set forth above together with the other advantages which are inherent within its structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth of shown in the accompanying drawings is to be interpreted as illustrative, and not in a limiting sense.

What is claimed is:

1. In a beverage container comprising a base capable of holding a liquid beverage, said base having an upper rim;

a collar secured to said upper rim, said collar including an outer wall, a flow ledge extending radially inward to a collar shaft, and at least one flow aperture extending through said flow ledge; and a cap including a cap body with a cap plug removably threaded to said collar shaft, and a top plate extending radially outward from said cap plug to overlie said at least one flow aperture; and a seal gasket mounted to said top plate such that rotation of said cap relative to said collar in a first direction will seat said seal gasket against said flow ledge and close said at least one flow aperture, and rotation of said cap relative to said collar in a second direction will space said seal gasket from said flow ledge and open said at least one flow aperture; the improvement comprising:

said seal gasket including a pair of circumferentially spaced seal stops extending therefrom and defining a notch therebetween; and said collar including a collar stop which will interfere with each of said seal stops during rotation of said cap with respect to said collar, such that seating of said collar stop within said notch provides a tactile indication to a user.

2. A beverage container as in claim 1, wherein said base is a tumbler sized for an individual beverage.

3. A beverage container as in claim 1, wherein said notch and said collar stop are circumferentially offset when said seal gasket is seated against said flow ledge, and rotation of said cap in the direction to open said at least one flow aperture brings said notch into circumferential alignment with said collar stop.

4. A beverage container as in claim 3, wherein said notch is in such circumferential alignment with said collar stop at a properly open position between 15 and 90 degrees rotation from seating of said seal gasket against said flow ledge.

5. A beverage container as in claim 1, wherein each of said seal stops takes the form of an inclined ramp increasing in height toward said notch.

6. A beverage container as in claim 5, wherein said top plate of said cap body includes a plurality of spaced teeth extending downwardly, and wherein said seal gasket includes a seal groove including gap walls, said seal gasket being mounted with said teeth received within said seal groove between said gap walls.

7. A beverage container as in claim 6, wherein said notch and said collar stop are circumferentially offset when said seal gasket is seated against said flow ledge, and rotation of said cap in the direction to open said at least one flow aperture brings said notch into circumferential alignment with said collar stop.

8. A beverage container as in claim 7, wherein said notch is in such circumferential alignment with said collar stop at a properly open position between 15 and 90 degrees rotation from seating of said seal gasket against said flow ledge.

* * * * *